US009679551B1

(12) United States Patent
Wiggins et al.

(10) Patent No.: US 9,679,551 B1
(45) Date of Patent: Jun. 13, 2017

(54) NOISE REDUCTION HEADPHONE WITH TWO DIFFERENTLY CONFIGURED SPEAKERS

(71) Applicant: Baltic Latvian Universal Electronics, LLC, Westlake Village, CA (US)

(72) Inventors: Daniel C. Wiggins, Port Hueneme, CA (US); Thomas Ezekiel Burgess, North Hollywood, CA (US); Matthew Fumio Yamamoto, Moorpark, CA (US)

(73) Assignee: Baltic Latvian Universal Electronics, LLC, Westlake Village, CA (US)

( * ) Notice: Subject to any disclaimer, the term of this patent is extended or adjusted under 35 U.S.C. 154(b) by 0 days.

(21) Appl. No.: 15/094,748

(22) Filed: Apr. 8, 2016

(51) Int. Cl.
*G10K 11/16* (2006.01)
*G10K 11/178* (2006.01)
*H04R 5/033* (2006.01)

(52) U.S. Cl.
CPC ..... *G10K 11/178* (2013.01); *H04R 5/033* (2013.01); *G10K 2210/1081* (2013.01); *G10K 2210/3046* (2013.01); *H04R 2460/01* (2013.01)

(58) Field of Classification Search
CPC ..... G10K 11/178; G10K 2210/1081; G10K 2210/3046; H04R 5/033; H04R 2460/01
USPC ..... 381/71.1, 71.6
See application file for complete search history.

(56) References Cited

U.S. PATENT DOCUMENTS

| | | | |
|---|---|---|---|
| 4,455,675 | A | 6/1984 | Bose et al. |
| 4,494,074 | A | 1/1985 | Bose |
| 4,644,581 | A | 2/1987 | Sapiejewski |
| 4,953,217 | A | 8/1990 | Twiney et al. |
| 5,181,252 | A | 1/1993 | Sapiejewski et al. |
| 5,182,774 | A | 1/1993 | Bourk |
| 5,675,658 | A | 10/1997 | Brittain |
| 6,597,792 | B1 | 7/2003 | Sapiejewski et al. |
| 6,898,290 | B1 | 5/2005 | Saunders et al. |
| 8,027,493 | B2 | 9/2011 | Levitsky |
| 8,077,874 | B2 | 12/2011 | Sapiejewski |
| 8,189,803 | B2 | 5/2012 | Bergeron et al. |
| 8,385,559 | B2 | 2/2013 | Thenerapperuma et al. |
| 8,737,636 | B2 | 5/2014 | Park et al. |
| 8,934,638 | B2 | 1/2015 | Kimura |
| 9,055,369 | B2 | 6/2015 | Yang |
| 2006/0239497 | A1* | 10/2006 | Yu ..... H04R 7/22 381/398 |

(Continued)

FOREIGN PATENT DOCUMENTS

| | | |
|---|---|---|
| JP | 63-33291 | 3/1988 |
| JP | 09-93684 | 4/1997 |

(Continued)

*Primary Examiner* — Disler Paul

(74) *Attorney, Agent, or Firm* — SoCal IP Law Group LLP; John E. Gunther; Steven C. Sereboff

(57) ABSTRACT

There is disclosed a noise reducing headphone including a headphone housing, a microphone generate an ambient audio signal representative of ambient noise, a processor to generate an anti-sound signal based on the ambient audio signal. A first speaker is disposed within the headphone housing to convert the anti-sound signal into anti-sound. A second speaker is disposed within the headphone housing to convert an audio input signal into high fidelity sound. At least one characteristic of the second speaker is different from a corresponding characteristic of the first speaker.

14 Claims, 4 Drawing Sheets

©2016 BALTIC LATVIAN UNIVERSAL ELECTRONICS

(56) References Cited

U.S. PATENT DOCUMENTS

| | | | | |
|---|---|---|---|---|
| 2007/0172081 | A1* | 7/2007 | Oxford | H04R 3/04 381/99 |
| 2008/0317255 | A1 | 12/2008 | Cozens et al. | |
| 2009/0141906 | A1 | 6/2009 | Truesdell | |
| 2009/0175463 | A1* | 7/2009 | Lee | H04R 3/005 381/71.6 |
| 2013/0273967 | A1* | 10/2013 | Dave | H04R 25/554 455/556.1 |
| 2014/0270222 | A1* | 9/2014 | Hendrix | H04R 1/24 381/71.6 |
| 2015/0264468 | A1* | 9/2015 | Bruins | H04R 1/1058 381/74 |

FOREIGN PATENT DOCUMENTS

| | | |
|---|---|---|
| JP | 2009-17485 | 1/2009 |
| WO | 2014-100573 A2 | 6/2014 |

* cited by examiner

©2016 BALTIC LATVIAN UNIVERSAL ELECTRONICS

©2016 BALTIC LATVIAN UNIVERSAL ELECTRONICS

©2016 BALTIC LATVIAN UNIVERSAL ELECTRONICS

©2016 BALTIC LATVIAN UNIVERSAL ELECTRONICS

NOISE REDUCTION HEADPHONE WITH TWO DIFFERENTLY CONFIGURED SPEAKERS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to noise reduction headphones, and specifically to noise reduction headphones capable of high fidelity reproduction of an audio input.

Description of the Related Art

A speaker is a transducer for converting electrical signals into acoustic waves. Typical speakers include a diaphragm or other flexible element that moves in response to an audio input signal. Typical speaker diaphragms are flat or have a conical shape, in which case the diaphragm is typically referred to as the "speaker cone". In either case, the motion of the diaphragm in response to the audio signal generates acoustic waves in the surrounding air. In a typical speaker, the diaphragm is mechanically coupled to a coil (commonly called a "voice coil" since early speakers were used to reproduce voice sounds) suspended in a magnetic field of a permanent magnet. An audio signal, in the form of a current passing through the coil, causes the coil to be alternately attracted and repelled by the magnetic field, resulting in corresponding motion of the diaphragm.

A headphone is a device that generates acoustic waves directly at a user's ear, and typically both ears. A typical headphone includes, for each ear, a housing and a flexible member intended to provide a seal between the housing and the user's ear or head. One or more speakers within the housing generate acoustic waves directed into the user's ear.

A noise reducing headphone is a type of headphone in which the speaker generates acoustic waves, commonly called "anti-noise", intended to cancel, at least in part, ambient noise. To effectively cancel a sound, the anti-noise has to have the same amplitude and frequency spectrum as the sound entering the user's ear, with each frequency component of the anti-noise shifted in phase by 180 degrees with respect to the corresponding frequency component of the sound. Because canceling a sound is general impractical, the discussion herein is with respect to reduction, with a reduction to zero the same as cancellation.

Throughout this description, elements appearing in figures are assigned three-digit reference designators, where the most significant digit is the figure number where the element first appears, and the two least significant digits are specific to the element. An element that is not described in conjunction with a figure may be presumed to have the same characteristics and function as a previously-described element having the same reference designator.

DETAILED DESCRIPTION

Figure 1:
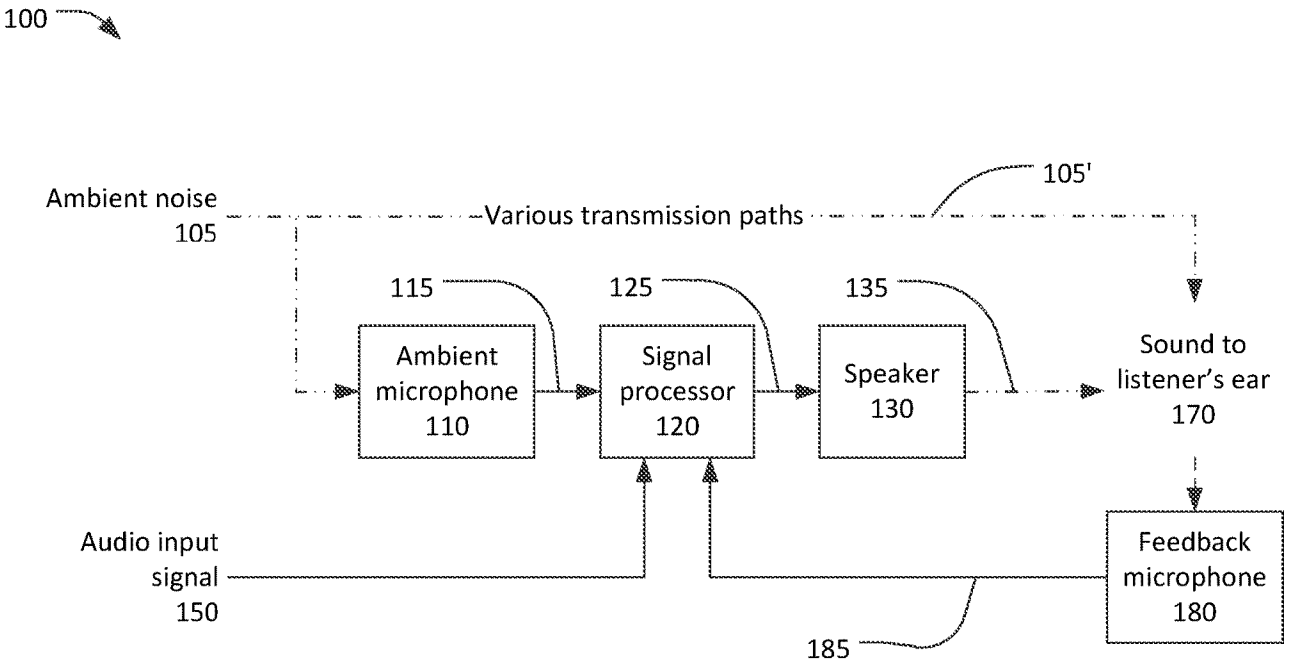
FIG. 1 PRIOR ART
FIG. 1 is a block diagram of a conventional active noise reducing headphone.

FIG. 1 is a simplified block diagram of a conventional noise reducing headphone 100, which includes an ambient microphone 110, a signal processor 120, a speaker 130, and a feedback microphone 180. The noise reducing headphone 100 sometimes includes one or more of preamplifiers, analog-digital converters, digital-analog converters and power amplifiers. In FIG. 1 and subsequent figures, solid arrows indicate electronic (analog or digital) signal paths and broken arrows indicate acoustic signal paths (i.e., acoustic waves propagating through air or some other medium).

Ambient noise 105 is converted into an ambient audio signal 115 by the ambient microphone 110. The term "ambient noise" means any ambient sounds that a listener does not want to hear or that interfere with the listener hearing more desirable sounds. The term "sound" means acoustic waves propagating in air. The term "audio signal" means an electronic representation of sound, which may be an analog signal or a digital data stream. The ambient audio signal 115 is an electronic representation of ambient sound. The term ambient is relative, and in this context relates to the immediate area external to the headphone.

The signal processor 120 receives the ambient audio signal 115, an optional external audio signal 150, and a feedback audio signal 185 from the feedback microphone 180. The external audio signal is typically recorded or streamed music, a telephone call or a movie sound track. The external audio signal is an analog signal or a digital data stream. Noise reduction, though, may be performed without an external audio signal. The signal processor processes the ambient audio signal 115, the external audio signal 150, and the feedback audio signal 185 and outputs a processed audio signal 135 that is converted into processed sound 135 by the speaker 130. The processes performed by the signal processor 120 sometimes include one or more of attenuation, amplification, filtering, equalization and phasing shifting.

The signal processor 120 is typically an analog processor or a digital signal processor. When the signal processor 120 is a digital signal processor, analog-to-digital converters (not shown) are typically used to convert analog signals from the ambient microphone 115, the feedback microphone 180, and, if required, the external audio signal into digital data streams. When the signal processor 120 is a digital signal processor, a digital-to-analog converter (not shown) is typically used to convert the processed audio signal 125 from a digital data stream to an analog signal.

The sound 170 provided to the listener's ear is a combination of the processed sound 135 and modified ambient noise 105' that reaches the listener's ear by transmission along various paths including acoustic transmission through the noise reducing headphone. For example, a typical set of sealed over-ear headphones attenuates ambient sound by more than 25 dB at frequencies above 1 kHz, but only 5 to 10 dB at the low frequencies prevalent in ambient noise. The processed sound 135 includes anti-sound to cancel, to at least some extent, the modified ambient noise 105' that would otherwise reach the listener's ear.

In some noise reducing headphones, the ambient microphone 110 is omitted. This configuration is commonly referred to as a feedback noise reduction headphone since the processor generates the anti-noise solely based on the audio signal 185 from the feedback microphone 180. In other noise reduction headphones, the feedback microphone 180 is omitted. This configuration is commonly referred to as a feed-forward noise reduction headphone since the processor generates the anti-noise without using feedback of the sound at the listener's ear. The configuration of the noise reduction headphone 100 shown in FIG. 1 is commonly referred to as a hybrid noise reduction headphone since it utilizes both feedback and feed-forward.

An issue arises when a conventional noise reduction headphone 100 is used to reduce noise in a loud environment while simultaneously reproducing an external audio signal. Most of the dynamic range of the speaker 130 may be required for reducing noise. Very little (in some cases, none) of the dynamic range of the speaker 130 may be left for audio reproduction. The result is a degraded, limited reproduction of the external audio signal. Additionally, intermodulation distortion can—and does—arise when using the same speaker 130 to both reduce loud, low frequency ambient noise and play an external audio signal. The high level of speaker diaphragm excursion required for noise reduction of low frequencies modulates the upper frequencies significantly, leading to poor reproduction of the external audio signal. In extreme cases, a noise reduction headphone produces an "underwater" sound where there is a constant warble superimposed on the external audio.

Figure 2:
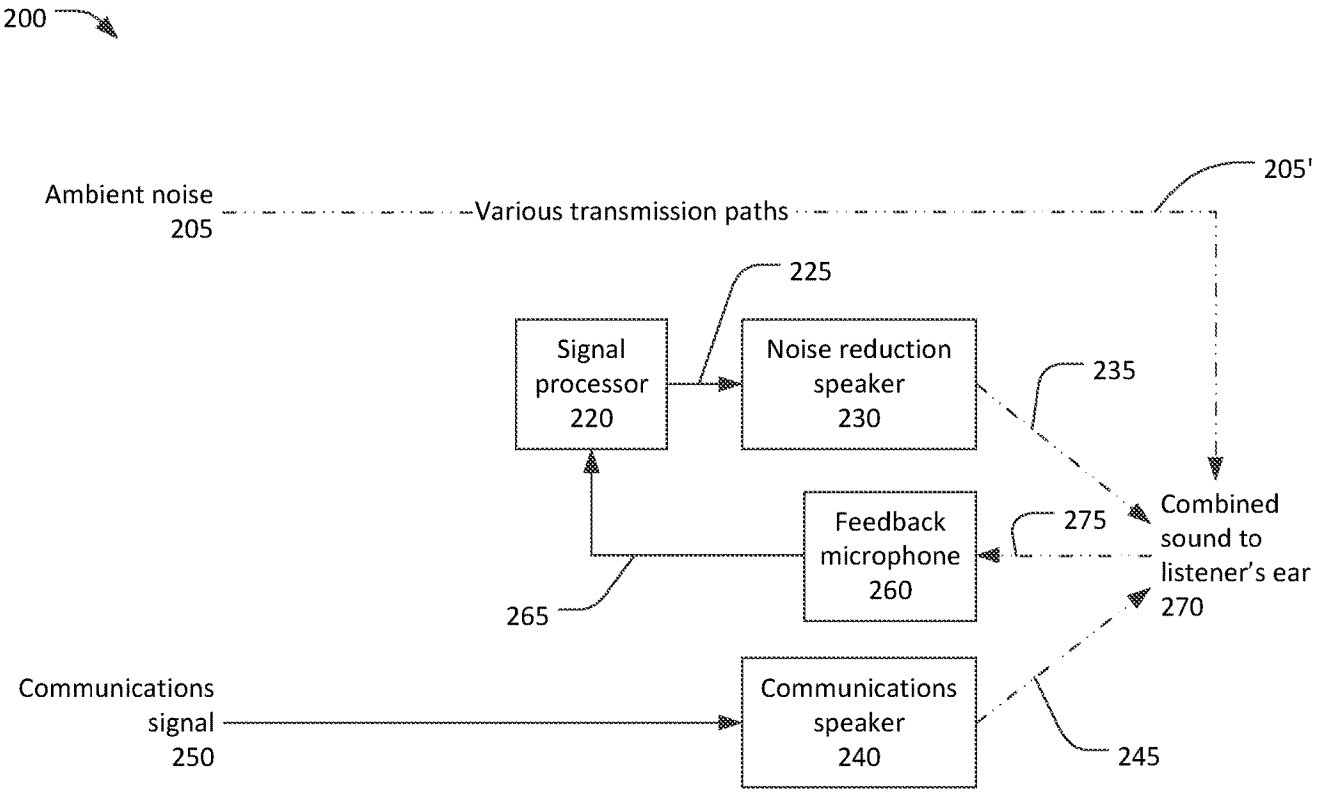
FIG. 2 PRIOR ART
FIG. 2 is a block diagram of a prior art active noise reducing headset.

FIG. 2 is a block diagram of an active noise reduction headset 200 described in U.S. Pat. No. 5,675,658. Unlike the noise reducing headphone 100 of FIG. 1, the active noise reduction headset 200 includes a noise reduction speaker 230 to produce anti-noise and a separate communications speaker 240 to convert a communications signal 250 from a radio into communications sound 245. The active noise reduction headset 200 also includes a signal processor 220 that generates an anti-noise signal 225 based on a feedback signal 265 received from a feedback microphone 260. The noise reduction speaker 230 transforms the anti-noise signal 225 into anti-noise 235.

The sound 270 provided to the listener's ear is a combination of the anti-noise 235 generated by the noise reduction speaker 230, the communications sound 245 from the communications speaker 240, and modified ambient noise 205' that reaches the listener's ear by transmission along various paths including mechanical transmission through the noise reducing head phone. A portion 275 of the combined sound 270 is incident on the feedback microphone 260. The feedback microphone 260 converts the portion 275 into the feedback signal 265 that is input to the processor 220.

At first impression, the use of separate noise reduction and communications speakers 230, 240 would appear to alleviate inter-modulation between the anti-noise 235 and the communications sound 245. However, upon further consideration, this is not the case. The patent describes the feedback microphone 260 as located along a midpoint between the noise reduction speaker 230 and the communication speaker 240. Thus the feedback microphone does not receive the ambient noise 205, but rather receives portions of the anti-noise 235, the communications sound 245, and the modified ambient noise 205'. The feedback signal 265 contains components representative of the anti-noise 235, the communications sound 245, and the modified ambient noise 205'. The patent does not disclose any method by which the signal processor 220 can distinguish between these components of the feedback signal 265. Thus, the anti-noise signal 225 and the anti-noise 235 inexorably include a component effective to reduce the communications sound 245. Any reduction of the communications sound 245 will be heard by the listener as a substantial distortion of the communications sound 245. Note that the intended application of the active noise reduction headset 200, as described in U.S. Pat. No. 5,675,658, is for aircraft pilots. The communications signal 215 is presumably limited to speech communications, in which case this distortion may be acceptable in the intended application.

Figure 3:
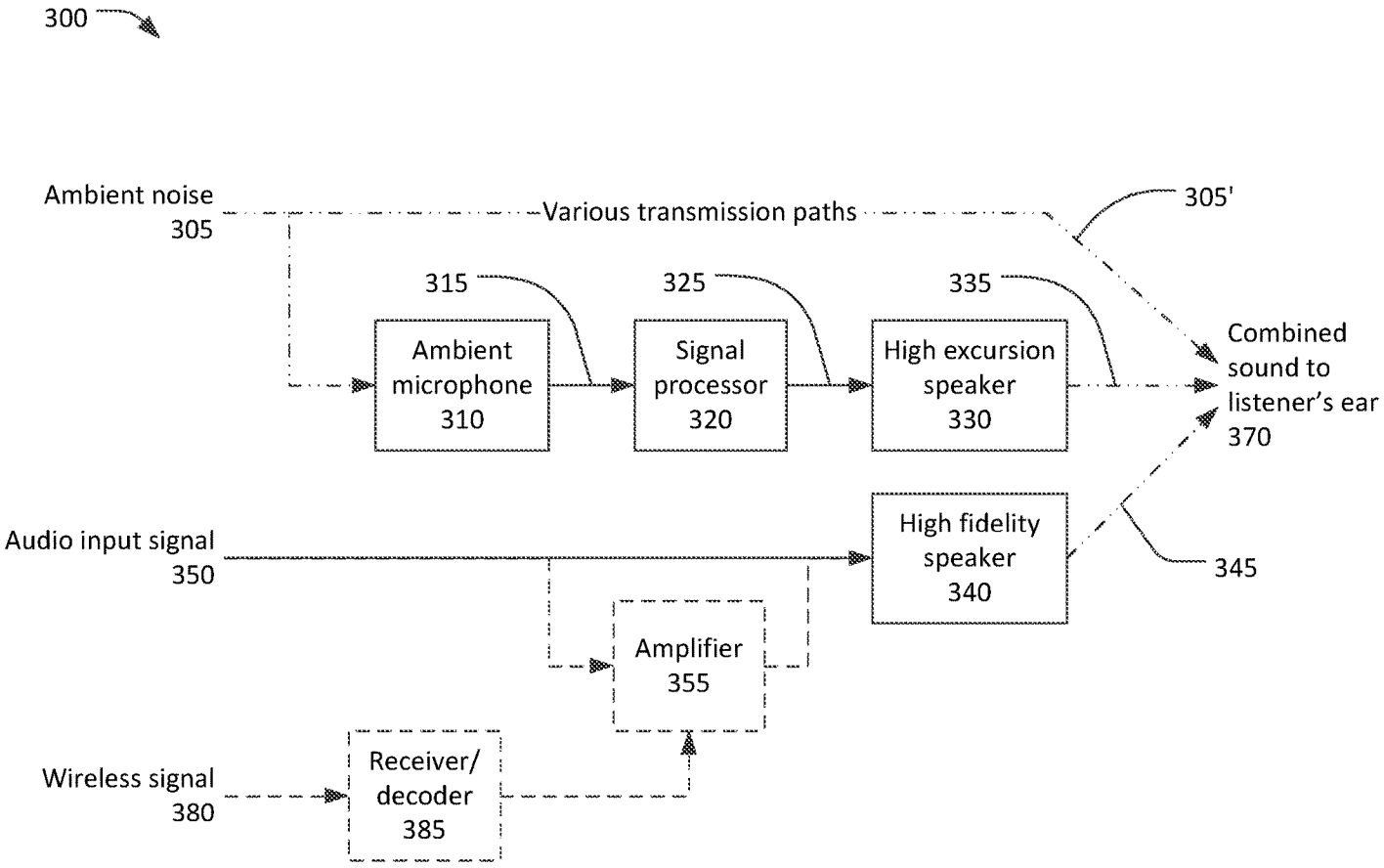
FIG. 3 is a block diagram of an active noise reducing headphone with two differently configured speakers.

FIG. 3 is a block diagram of a noise reduction headphone 300 with dual differently configured speakers. The noise reduction headphone 300 includes a "high excursion" speaker 340 configured to generate high power, low frequency, anti-sound to reduce ambient noise, and a "high fidelity" speaker 360 configured for high fidelity reproduction of an audio input signal 350. The term "excursion" refers to the range of motion of the speaker cone or diaphragm. The term "high fidelity" implies low distortion over a broad frequency range. The noise reduction headphone 300 also includes an ambient microphone 320 and a signal processor 330. The noise reduction headphone 300 may optionally include an amplifier 355 and a wireless receiver/decoder 385.

Ambient noise 305 is converted into an ambient audio signal 315 by the ambient microphone 310. The signal processor 320 processes the ambient audio signal 315 to produce an anti-sound signal 325 that is converted into anti-sound 335 by the high excursion speaker 330.

The signal processor 320 is an analog processor or a digital signal processor. When the signal processor 320 is a digital signal processor, an analog-to-digital converter (not shown) is used to an audio signal from the ambient microphone 310 into a digital data stream 315. When the signal processor 320 is a digital signal processor, a digital-to-analog converter (not shown) is used to convert the processed anti-sound signal 325 from a digital data stream to an analog signal.

The processor 320 may utilize a model of the various transmission paths that allow the ambient noise 305 to reach the listener's ear as the modified ambient noise 305'. The processor may utilize this model to predict the modified ambient noise 305' based on the ambient audio signal from the ambient microphone 310. The processor 320 may then generate the anti-sound signal 325 configured to reduce the modified ambient noise 305'. The processes performed by the signal processor 320 to generate the anti-sound signal 325 may include attenuation, amplification, filtering, equalization, phasing shifting, and other processes.

The audio input signal 350 may be, for example, music, a telephone call, a movie sound track, or other audio content. The audio input signal 350 may be provided by a media player, an aircraft in-seat entertainment system, or some other source. The audio input signal may be provided with sufficient power to drive the high fidelity speaker 340 directly. The audio input signal may be provided at lower power and amplified by the amplifier 355 within the noise reduction headphone 300. The audio input may be a wireless signal 380 that is received and decoded by the receiver decoder 385 and amplified by the amplifier 355. The wireless signal 380 may be in accordance with a standard wireless communications protocol, such as WiFi® or Bluetooth®, or a proprietary protocol. In all cases, the high fidelity speaker 340 converts the audio input signal 350 into high fidelity sound 345. The high fidelity speaker 340 may be a single speaker or may include multiple transducers, in which case additional circuitry (not shown) is required to divide the audio input signal between the transducers.

In the noise reduction headphone 300, the audio input and the ambient noise are never mixed or combined electronically. Since they are not combined electronically and are reproduced by separate speakers, inter-modulation distortion of the audio signal due to high ambient noise levels does not occur.

The anti-sound 335 generated by the high excursion speaker 330, the high fidelity sound 345 generated by the high fidelity speaker 340, and the modified ambient sound 305' acoustically combine in an air volume adjacent to and within the listener's ear to produce combined sound 370. Ideally, the anti-sound 335 totally or substantially cancels the modified ambient noise 305' such that the listener hears only or predominantly the high fidelity sound 345. Since the high fidelity sound 345 and the anti-sound 335 are generated completely independently, there is no inter-modulation distortion of the high fidelity sound. Further, the high excursion speaker 330 and the high fidelity speaker 340 can be configured differently to perform their respective functions.

The spectrum of ambient noise tends to be pink (decreasing at 3 dB per octave), so that the actual amount of noise energy at higher frequencies is low compared to noise energy at low frequencies. Furthermore, hearing acuity decreases with frequency. Given that both noise energy and hearing acuity decrease with frequency, the bandwidth over which active noise reduction is effective can generally be limited to no more than 2 kHz. Noise reduction at lower frequencies is critical to allow the listener to hear the lower octaves of music.

To effectively reduce the ambient noise, the anti-noise must precisely replicate, with a 180-degree phase shift, the modified ambient noise 305'. To accomplish this objective, the processing performed by the signal processor 320 must compensate for the effects of the transmission paths by which the modified ambient noise 305' reaches the listener's ear. Further, the processing performed by the signal processor 320 must compensate for any spectral nonlinearity of the high excursion speaker 330 that generates the anti-sound. Finally, the processing performed by the signal processor 320 must compensate for any distortion of the high excursion speaker 330. Distortion is, by definition, spurious information created by the speaker. Unless compensated, distortion introduced by the high excursion speaker 330 will result in degraded noise reduction performance. Even and odd harmonics are equally important since distortion of either will affect the accuracy of the noise reduction. To simplify and improve the accuracy of the processing performed by the signal processor 320, it is preferred that the high excursion speaker have flat bandwidth and very low distortion for frequencies less than 2 kHz.

The mechanical isolation from a typical set of sealed, over-ear headphones is typically 5 to 10 dB at low frequencies. The volume of sounds can be quantified in terms of sound pressure level (SPL). The unit of SPL measurement is the Pascal (Pa). Sound pressure levels are common expressed using a logarithmic scale as dBPa. In some circumstances, ambient noise can reach SPL of 100 dBPa or greater, with most of the noise energy concentrated at low frequencies. Thus the high excursion speaker 330 may have to generate low frequency anti-noise with a SPL of 95 dBPa or more. To provide the required levels of low frequency anti-noise, the high excursion speaker 330 requires both very low resonant frequency and very high excursion.

Low speaker resonant frequency requires a high moving mass. High moving mass inherently results in reduced high frequency performance, which is irrelevant (at least for frequencies above 2 kHz) for the high excursion speaker 330.

The factor that limits the overall performance of the noise reduction headphone 300 is likely to be the excursion limit of the high excursion speaker 330. In a sealed system for a fixed SPL, speaker excursion must increase by a factor of 4 for every octave reduction in frequency. For example, assuming an excursion of 1 mm is required to cancel noise at 200 Hz, 4 mm of excursion is required to cancel the same noise power level at 100 Hz, and 16 mm of excursion is required to cancel the same noise power level at 50 Hz.

Unlike the high excursion speaker 330, the high fidelity speaker 340 should be capable of reproducing an entire listenable audio frequency range, which may be from 20 Hz to 20 kHz. To play to 20 kHz, the speaker must have low electrical inductance and low motional inductance. The requirement for low electrical inductance dictates a speaker with a small and short voice coil. The requirement for low motional inductance dictates a speaker with low moving mass. High electrical inductance or high moving mass will result in compromised high frequency performance.

While the high fidelity speaker 340 must be capable of reproducing sounds from 20 Hz to 20 kHz, the frequency response of the high fidelity speaker 340 may not necessarily be flat over this frequency range. At least some research indicates that listeners prefer headphones where the frequency response is not flat, but rather exhibits an increasing response at frequencies below 200 Hz, a response peak around 3 kHz, and gradually decreasing response at frequencies above 3 kHz. This frequency response is often referred to as the "Harman Target Response."

Whether the high fidelity speaker 340 has a flat frequency response or a frequency response tailored to listener preferences, the high fidelity speaker 340 needs low distortion. Preferably the distortion of the high fidelity speaker 340 is below the limits of audibility. For example, the total harmonic distortion of the high fidelity speaker at SPL of 94 dB may be specified to be less than 3% for frequencies below 300 Hz, less than 1% for frequencies from 300 Hz to 5 kHz, and less than 2% for frequencies from 5 kHz to 20 kHz.

Typical average listening levels for music and other audio entertainment are around 70 to 80 dB SPL, with peaks being 10-15 dB SPL above that. Thus the high fidelity speaker 340 needs an excursion range sufficient to generate 80 to 95 dB SPL. However, in contrast to the high excursion speaker 330, the sound produced by the high fidelity speaker 340 is not necessarily concentrated in the low frequencies.

The high excursion speaker 330 may be configured to provide a maximum SPL at least 3 dB higher than the maximum SPL capability of the high fidelity speaker 340. For equal speaker diaphragm diameters, the high excursion speaker 330 may be configured to have a maximum stroke at least two times the maximum stroke of the high fidelity speaker 340. Further, the high excursion speaker 330 may be configured to have a moving mass at least two times the moving mass of the high fidelity speaker 340.

The requirements on the high excursion speaker 330 configured for noise reduction are, as discussed, substantially different from the requirements on the high fidelity speaker 340 configured for high fidelity audio reproduction. Using two identical speakers to satisfy both noise reduction and high fidelity audio reproduction functions in a noise reducing headphone requires tradeoffs and compromises between noise reduction capability and audio reproduction quality. Such compromises can be avoided or minimized using two differently configured speakers.

The noise reduction headphone 300 may be one half of a pair of headphones for high fidelity reproduction of stereophonic audio input signals and ambient noise reduction at both of a listener's ears. Each of a pair of stereo headphones includes a high excursion speaker 340, and a high fidelity speaker 360, and an ambient microphone 320. The ambient audio signals produced by the ambient microphones are processed separately to produce respective anti-sound signals 345. Each of the pair of headphones may include a signal processor 320. Since some signal processor devices have dual channels intended for processing stereo audio signals, both signal processors 320 may be implemented using a single dual-channel signal processor device located in one of the pair of headphones.

Figure 4:
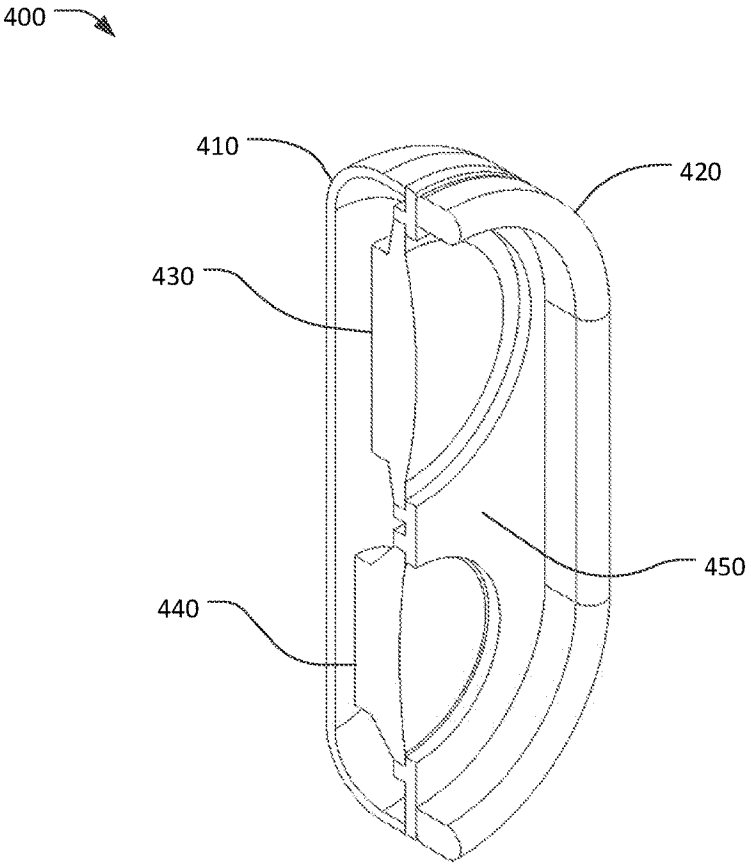
FIG. 4 is a perspective cross-sectional view of an active noise reducing headphone with dual, separately optimized, speakers.

FIG. 4 is a perspective cross-sectional view of an exemplary active noise reduction headphone 400, which may be the noise reduction headphone 300 with two differently configured speakers. The noise reduction headphone 400 may be one half of a pair of stereo noise reduction headphones. A high excursion speaker 430 configured for noise reduction and a high fidelity speaker 440 configured for audio reproduction are disposed side-by-side within a headphone housing 410. The speakers 430, 440 may be mounted on a plate 450 that, together with the headphone housing 410, forms a cavity behind the speakers. A gasket 420 may be configured to fit over the ear of a listener (not shown) and provide a seal between the headphone housing 410 and the head of the listener. Other configurations of an active noise reduction headphone may be configured to fit on or within the listener's ear.

A diameter of the high excursion speaker 440 is not necessarily the same as a diameter of the high fidelity speakers 430. Configuring the high excursion speaker 440 to have a smaller diameter may allow a more "ear-like" contour for the perimeter of the headphone housing 410 and provide a better fit of the headphone over the listener's ear. However, since SPL is proportional to the volume of air moved by a speaker, a reduction in the diameter of the high excursion speaker 440 must be offset by a counterpart increase in the maximum stroke of the high excursion speaker 440.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of" respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A noise reducing headphone, comprising:

a headphone housing;

a microphone to generate an ambient audio signal representative of ambient noise external to the headphone housing;

a processor to generate an anti-sound signal based on the ambient audio signal;

a first speaker disposed within the headphone housing to convert the anti-sound signal into anti-sound; and a second speaker disposed within the headphone housing to convert an audio input signal into high fidelity sound, wherein the first speaker is configured to convert the anti-sound signal into the anti-sound and the second speaker is differently configured to convert the audio input signal into the high fidelity sound, a moving mass of the first speaker greater than or equal to twice a moving mass of the second speaker, and the first speaker is dedicated to converting the anti-sound signal into the anti-sound and the second speaker is dedicated to converting the audio input signal into the high fidelity sound.

2. The noise reducing headphone of claim 1, wherein the first speaker is configured to provide a maximum sound pressure level at least 3 dB higher than a maximum sound pressure level of the second speaker.

3. A method of operating a noise reducing headphone, comprising:

generating an ambient audio signal representative of ambient noise;

generating an anti-noise signal based on the ambient audio signal;

converting the anti-sound signal into anti-sound using a first speaker; and converting an audio input signal into high fidelity sound using a second speaker, wherein the first speaker is configured to convert the anti-sound signal into the anti-sound and the second speaker is differently configured to convert the audio input signal into the high fidelity sound, a moving mass of the first speaker greater than or equal to twice a moving mass of the second speaker, and the first speaker is dedicated to converting the anti-sound signal into the anti-sound and the second speaker is dedicated to converting the audio input signal into the high fidelity sound.

4. The method of operating a noise reducing headphone of claim 3, wherein the first speaker is configured to provide a maximum sound pressure level at least 3 dB higher than a maximum sound pressure level of the second speaker.

5. A stereographic noise canceling headphone, comprising:

a first headphone comprising:

a first microphone to generate a first ambient audio signal representative of ambient noise external to the first headphone;

a first noise reduction speaker to convert a first anti-sound signal into anti-sound; and a first audio reproduction speaker to convert a first audio input signal into high fidelity sound;

a second headphone comprising:

a second microphone to generate a second ambient audio signal representative of ambient noise external to the second headphone;

a second noise reduction speaker to convert a second anti-sound signal into anti-sound; and a second audio reproduction speaker to convert a second audio input signal into high fidelity sound;

a first processor to generate the first anti-sound signal based on the first ambient audio signal; and a second processor to generate the second anti-sound signal based on the second ambient audio signal, wherein the first and second noise reduction speakers are configured to convert the first and second anti-sound signals into the anti-sound and the first and second audio speakers are differently configured to convert the first and second audio input signals into the high fidelity sound, a moving mass of each of the first and second noise reduction speakers being greater than or equal to twice a moving mass of each of the first and second audio reproduction speakers, and the first and second noise reduction speakers are dedicated to converting the first and second anti-sound signals into the anti-sound and the first and second audio speakers are dedicated to converting the first and second audio input signals into the high fidelity sound.

6. The stereographic noise canceling headphone of claim 5, wherein the first processor is located within the first headphone, and the second processor is located within the second headphone.

7. The stereographic noise canceling headphone of claim 5, wherein the first and second processors are implemented, at least in part, by a single processor device located in one of the first and second headphones.

8. A noise reducing headphone, comprising:

a headphone housing;

a microphone to generate an ambient audio signal representative of ambient noise external to the headphone housing;

a processor to generate an anti-sound signal based on the ambient audio signal;

a first speaker disposed within the headphone housing to convert the anti-sound signal into anti-sound; and a second speaker disposed within the headphone housing to convert an audio input signal into high fidelity sound, wherein the first speaker is configured to convert the anti-sound signal into the anti-sound and the second speaker is differently configured to convert the audio input signal into the high fidelity sound, a maximum stroke of the first speaker greater than or equal to twice a maximum stroke of the second speaker, and the first speaker is dedicated to converting the anti-sound signal into the anti-sound and the second speaker is dedicated to converting the audio input signal into the high fidelity sound.

9. The noise reducing headphone of claim 8, wherein the first speaker is configured to provide a maximum sound pressure level at least 3 dB higher than a maximum sound pressure level of the second speaker.

10. A method of operating a noise reducing headphone, comprising:

generating an ambient audio signal representative of ambient noise;

generating an anti-noise signal based on the ambient audio signal;

converting the anti-sound signal into anti-sound using a first speaker; and converting an audio input signal into high fidelity sound using a second speaker, wherein the first speaker is configured to convert the anti-sound signal into the anti-sound and the second speaker is differently configured to convert the audio input signal into the high fidelity sound, a maximum stroke of the first speaker greater than or equal to twice a maximum stroke of the second speaker, and the first speaker is dedicated to converting the anti-sound signal into the anti-sound and the second speaker is dedicated to converting the audio input signal into the high fidelity sound.

11. The method of operating a noise reducing headphone of claim 10, wherein the first speaker is configured to provide a maximum sound pressure level at least 3 dB higher than a maximum sound pressure level of the second speaker.

12. A stereographic noise canceling headphone, comprising:

a first headphone comprising:

a first microphone to generate a first ambient audio signal representative of ambient noise external to the first headphone;

a first noise reduction speaker to convert a first anti-sound signal into anti-sound; and a first audio reproduction speaker to convert a first audio input signal into high fidelity sound;

a second headphone comprising:

a second microphone to generate a second ambient audio signal representative of ambient noise external to the second headphone;

a second noise reduction speaker to convert a second anti-sound signal into anti-sound; and a second audio reproduction speaker to convert a second audio input signal into high fidelity sound;

a first processor to generate the first anti-sound signal based on the first ambient audio signal; and a second processor to generate the second anti-sound signal based on the second ambient audio signal, wherein the first and second noise reduction speakers are configured to convert the first and second anti-sound signals into the anti-sound and the first and second audio speakers are differently configured to convert the first and second audio input signals into the high fidelity sound, a maximum stroke of each of the first and second noise reduction speakers being greater than or equal to twice a maximum stroke of each of the first and second audio reproduction speakers, and the first and second noise reduction speakers are dedicated to converting the first and second anti-sound signals into the anti-sound and the first and second audio speakers are dedicated to converting the first and second audio input signals into the high fidelity sound.

13. The stereographic noise canceling headphone of claim 12, wherein the first processor is located within the first headphone, and the second processor is located within the second headphone.

14. The stereographic noise canceling headphone of claim 12, wherein the first and second processors are implemented, at least in part, by a single processor device located in one of the first and second headphones.

* * * * *